US011167169B1

(12) United States Patent
Harris

(10) Patent No.: US 11,167,169 B1
(45) **Date of Patent: *Nov. 9, 2021**

(54) MOUTHPIECE

(71) Applicant: Jawzrsize, LLC, Wailuku, HI (US)

(72) Inventor: Brandon Harris, Wailuku, HI (US)

(73) Assignee: Jawzrsize, LLC, Wailuku, HI (US)

( * ) Notice: Subject to any disclaimer, the term of this patent is extended or adjusted under 35 U.S.C. 154(b) by 1 day.

This patent is subject to a terminal disclaimer.

(21) Appl. No.: 16/385,174

(22) Filed: Apr. 16, 2019

Related U.S. Application Data

(63) Continuation-in-part of application No. 15/470,983, filed on Mar. 28, 2017, now Pat. No. 10,617,910.

(60) Provisional application No. 62/316,655, filed on Apr. 1, 2016.

(51) Int. Cl.
*A63B 23/03* (2006.01)
*A63B 21/02* (2006.01)
*A63B 21/002* (2006.01)

(52) U.S. Cl.
CPC ..... *A63B 23/032* (2013.01); *A63B 21/0023* (2013.01); *A63B 21/023* (2013.01)

(58) Field of Classification Search
CPC ... A63B 23/032; A61F 5/566; A61M 16/0493
See application file for complete search history.

(56) References Cited

U.S. PATENT DOCUMENTS

| | | | | |
|---|---|---|---|---|
| 9,956,111 | B2 | 5/2018 | Togliatti | |
| 10,617,910 | B1 * | 4/2020 | Harris | A63B 21/023 |
| 2005/0192157 | A1 * | 9/2005 | Norton | A63B 21/002 482/11 |
| 2012/0145162 | A1 | 6/2012 | Haddix et al. | |
| 2017/0239516 | A1 * | 8/2017 | Lee | A63B 21/026 |
| 2019/0365311 | A1 * | 12/2019 | Lee | A61B 5/002 |

OTHER PUBLICATIONS

Notice of Allowance, dated Jan. 30, 2020, from corresponding U.S. Appl. No. 15/470,983.
Office Action, dated Oct. 1, 2019, from corresponding U.S. Appl. No. 15/470,983.
Final Office Action, dated Jun. 7, 2019, from corresponding U.S. Appl. No. 15/470,983.
Office Action, dated Mar. 21, 2019, from corresponding U.S. Appl. No. 15/470,983.

* cited by examiner

*Primary Examiner* — Jennifer Robertson
(74) *Attorney, Agent, or Firm* — Brient IP Law, LLC

(57) ABSTRACT

The mouthpiece includes an enhanced mouthpiece, a data sensor, and a personal data device. The data sensor collects data regarding the bite force, the number of bites and the duration of each bite. The data sensor wirelessly transfers the collected data to a personal data device.

20 Claims, 7 Drawing Sheets

MOUTHPIECE

CROSS REFERENCES TO RELATED APPLICATIONS

This non-provisional application is a continuation-in-part application filed under 37 CFR 1.53(b) that claims the benefit of United States 35 USC 120 from U.S. patent application Ser. No. 15/470,983, filed on Mar. 28, 2017, entitled "Mouthpiece," which claims the benefit of priority to U.S. Provisional Application Ser. No. 62/316,655 filed Apr. 1, 2016, the disclosures of which are incorporated herein by reference in their entirety.

STATEMENT REGARDING FEDERALLY SPONSORED RESEARCH

Not Applicable

REFERENCE TO APPENDIX

Not Applicable

BACKGROUND OF THE INVENTION

The present invention relates to the field of field of sports games and amusements including apparatus for physical training, more specifically, an electronic control for monitoring athletic performance. (A63B24/0059)

This non-provisional application is a continuation-in-part application filed under 37 CFR 1.53(b) that claims the benefit of United States 35 USC 120 from non-provisional application U.S. Ser. No. 15/4470,983 filed on Mar. 28, 2017, by the inventor: Brandon Harris. This non-provisional application incorporates non-provisional application U.S. Ser. No. 15/4470,983 in its entirety.

The present disclosure will only reference the elements of the non-provisional application U.S. Ser. No. 15/4470,983 that are relevant to the innovations disclosed within this application. This is done for purposes of simplicity and clarity of exposition. The applicant notes that this disclosure incorporates non-provisional application U.S. Ser. No. 15/4470,983 in its entirety into this application. The fact that any specific innovation selected from the one or more innovations disclosed within U.S. Ser. No. 15/4470,983 is not addressed in this application should not be interpreted as an indication of defect in the above-referenced patent.

Within this disclosure, the non-provisional application U.S. Ser. No. 15/4470,983 will also be referred to as the prior disclosure.

A summary of the disclosures contained within prior disclosure that is relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The non-provisional application U.S. Ser. No. 15/4470,983 discloses an original mouthpiece 111 configured to exercise the muscles around the tongue 203, jaw and mouth 210 of a user 200. The original mouthpiece 111 inserts into the mouth 210 of the user 200 between the superior dentition 201 and the inferior dentition 202 of the user 200. The use of the original mouthpiece 111 for exercise involves the user 200 using the superior dentition 201 and the inferior dentition 201 to apply a compressive force 143 to the original mouthpiece 111 through a biting motion. The structure of the original mouthpiece 111 is selected from the group consisting of: a) a semi-rigid structure with an elastic nature; and, b) a rigid structure.

The original mouthpiece 111 further comprises a cavity 141 and a removable insert 142. The cavity 141 is a prism-shaped negative space that is formed through the structure of the original mouthpiece 111. The cavity 141 collapses under the compressive force 143 of the bite of a user 200. The removable insert 142 is a prism-shaped semi-rigid structure with an elastic nature. The removable insert 142 is geometrically similar to the cavity 141 such that the removable insert 142 inserts into the cavity 141. The removable insert 142 is formed with a modulus, which is a function that measures and describes the percentage of compression of removable insert 142 as a function of the compressive force 143 applied to the original mouthpiece 111. Any first removable insert 142 of a first modulus can be replaced by any second removable insert 142 of a second modulus such that the resistive force presented by the original mouthpiece 111 can be adjusted by the replacement of the first removable insert 142 with the second removable insert 142.

SUMMARY OF INVENTION

This non-provisional application is a continuation-in-part application filed under 37 CFR 1.53(b) that claims the benefit of United States 35 USC 120 from non-provisional application U.S. Ser. No. 15/4470,983 filed on Mar. 28, 2017, by the inventor: Brandon Harris. This non-provisional application incorporates non-provisional application U.S. Ser. No. 15/4470,983 in its entirety.

The present disclosure will only reference the elements of the non-provisional application U.S. Ser. No. 15/4470,983 that are relevant to the innovations disclosed within this application. This is done for purposes of simplicity and clarity of exposition. The applicant notes that this disclosure incorporates non-provisional application U.S. Ser. No. 15/4470,983 in its entirety into this application. The fact that any specific innovation selected from the one or more innovations disclosed within U.S. Ser. No. 15/4470,983 is not addressed in this application should not be interpreted as an indication of a defect in the above-referenced patent.

The data collecting mouthpiece is an exercise device. The data collecting mouthpiece is adapted for use with a user. The data collecting mouthpiece inserts in the mouth of the user. A biting motion between the superior dentition and the inferior dentition of the mouth creates a compressive force that exercises the muscles around the jaw, tongue and mouth of the user. The data collecting mouthpiece comprises an enhanced mouthpiece, a data sensor, and a personal data device. The enhanced mouthpiece comprises the original mouthpiece described by non-provisional application U.S. Ser. No. 15/4470,983 which is incorporated into this disclosure in its entirety. The enhanced mouthpiece is substantially identical in construction to the original mouthpiece. The enhancements made by the present disclosure to the original mouthpiece to form the enhanced mouthpiece comprises the installation of the data sensor into the enhanced mouthpiece. The data sensor collects data regarding the bite force, the number of bites and the duration of each bite. The data sensor wirelessly transfers the collected data to a personal data device.

These together with additional objects, features and advantages of the data collecting mouthpiece will be readily apparent to those of ordinary skill in the art upon reading the following detailed description of the presently preferred, but nonetheless illustrative, embodiments when taken in conjunction with the accompanying drawings.

In this respect, before explaining the current embodiments of the data collecting mouthpiece in detail, it is to be understood that the data collecting mouthpiece is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the data collecting mouthpiece.

It is therefore important that the claims be regarded as including such equivalent construction insofar as they do not depart from the spirit and scope of the data collecting mouthpiece. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
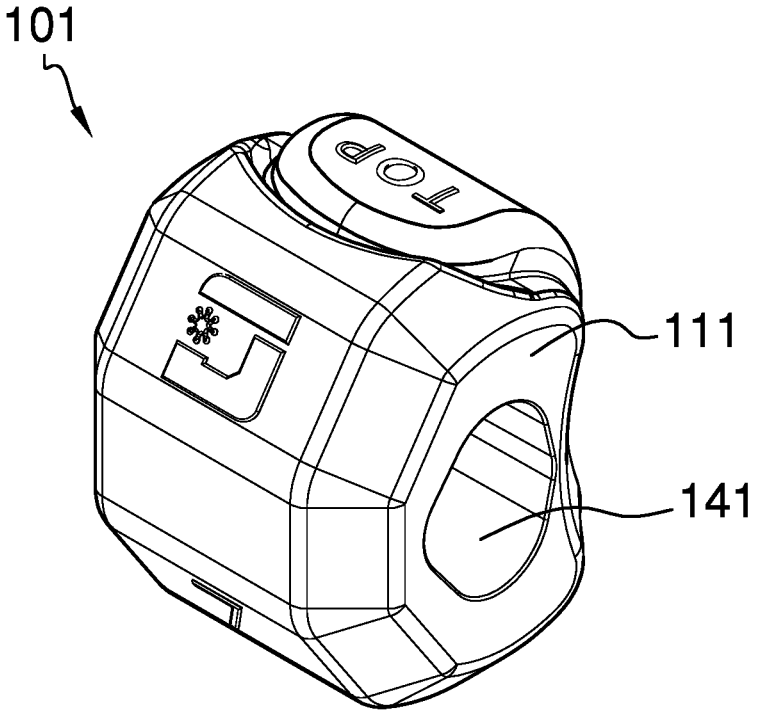
FIG. 1 is a perspective view of an embodiment of the disclosure.
Figure 2:
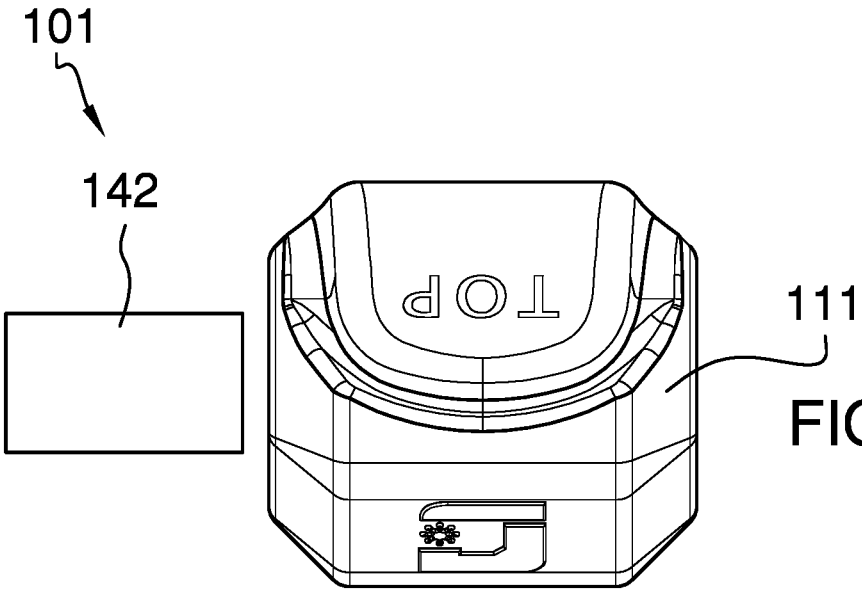
FIG. 2 is a top view of an embodiment of the disclosure.
Figure 3:
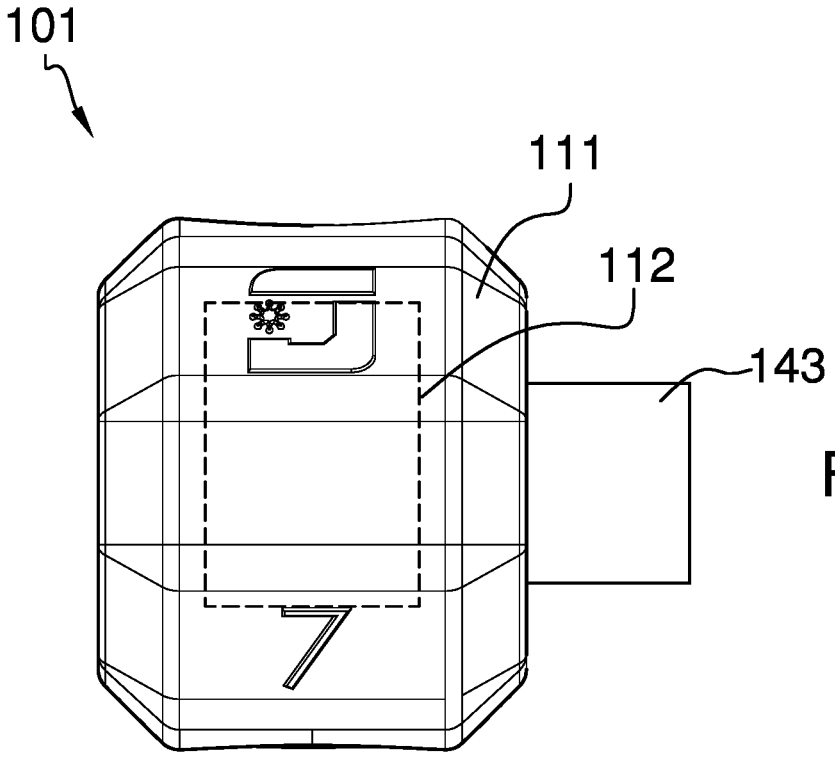
FIG. 3 is a front view of an embodiment of the disclosure.
Figure 4:
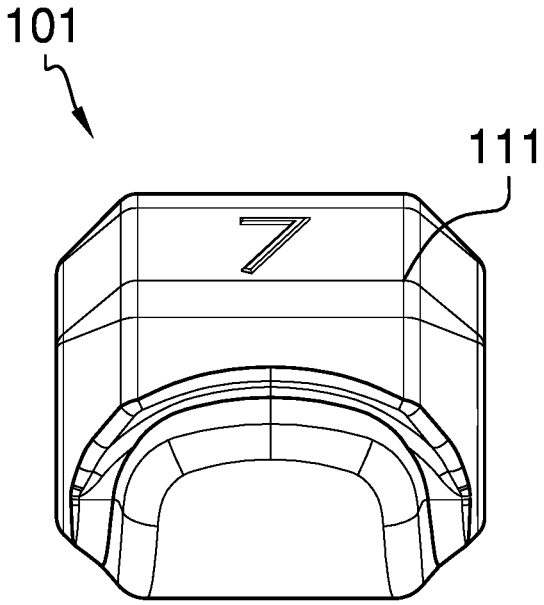
FIG. 4 is a bottom view of an embodiment of the disclosure.
Figure 5:
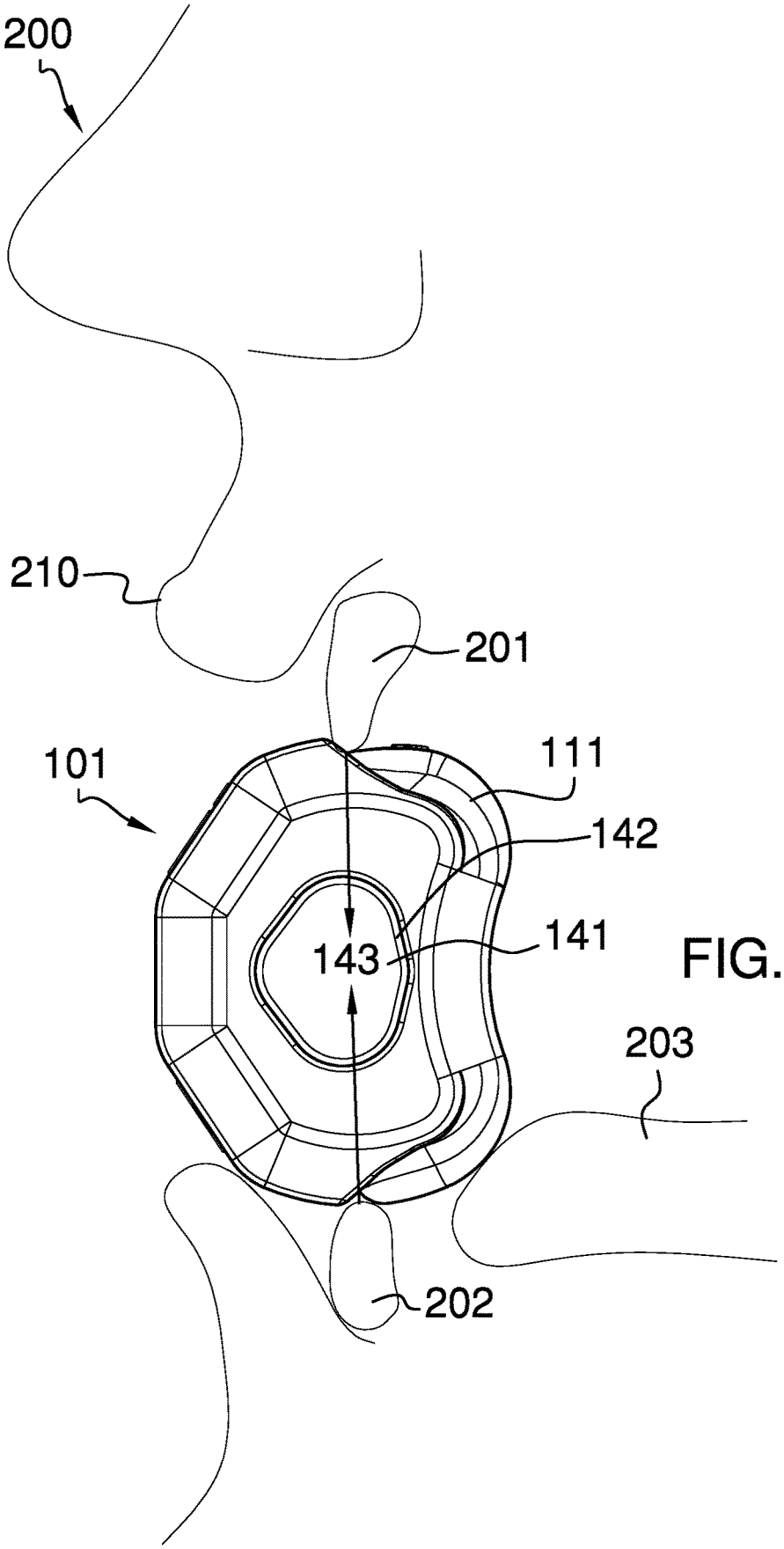
FIG. 5 is a side view of an embodiment of the disclosure.
Figure 6:
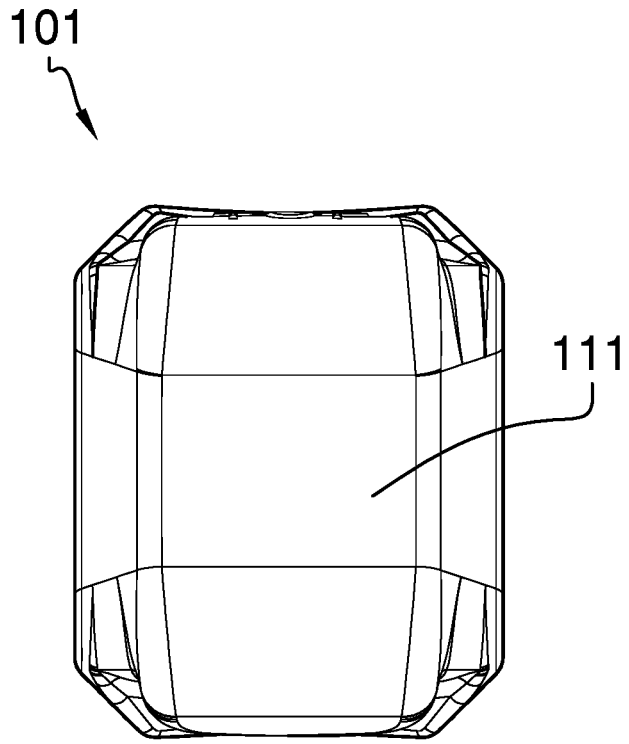
FIG. 6 is a rear view of an embodiment of the disclosure.
Figure 7:
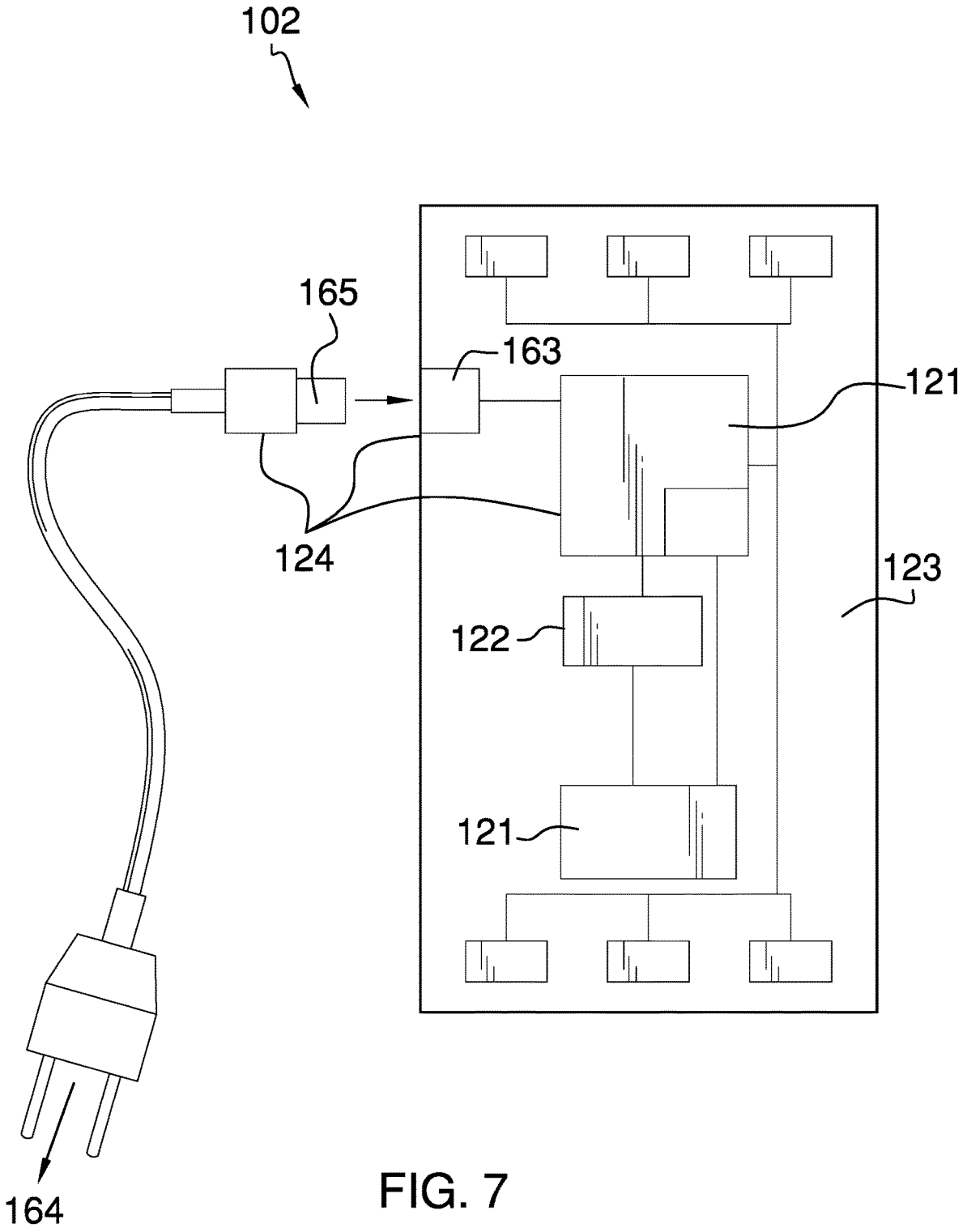
FIG. 7 is a detail view of an embodiment of the disclosure.
Figure 8:
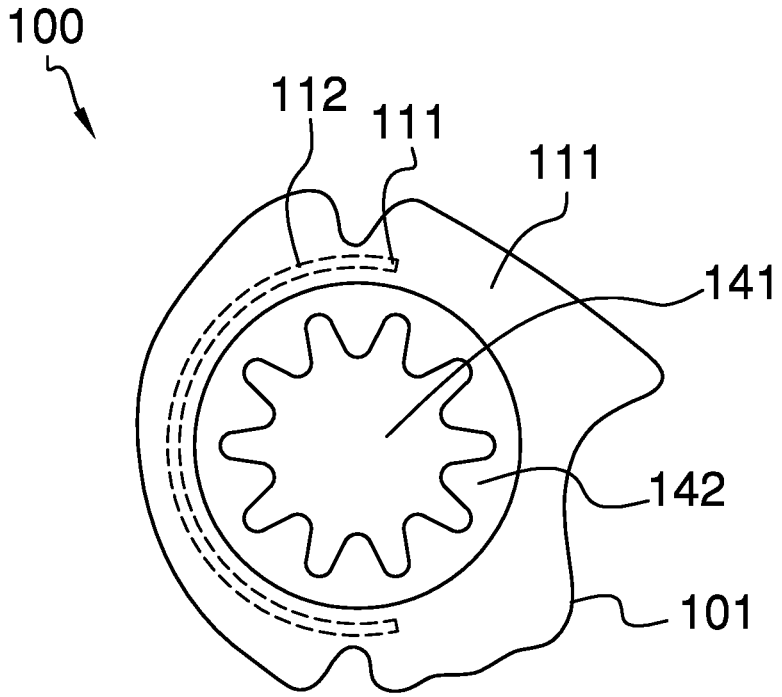
FIG. 8 is a detail side view of an embodiment of the disclosure.
Figure 9:
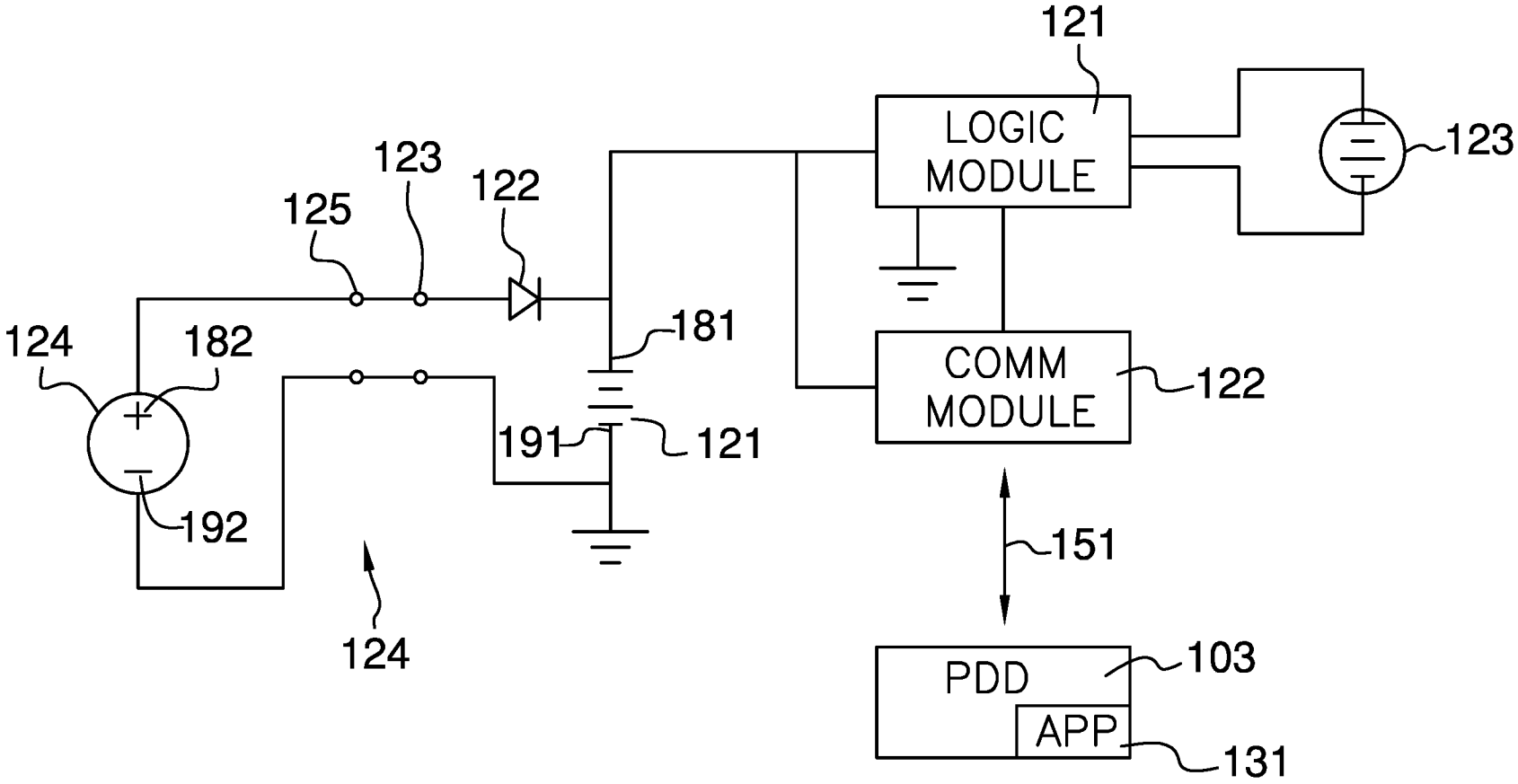
FIG. 9 is a block diagram of an embodiment of the disclosure.

Detailed reference will now be made to one or more potential embodiments of the disclosure, which are illustrated in FIGS. 1 through 9.

The data collecting mouthpiece 100 (hereinafter invention) is an exercise device. The invention 100 is adapted for use with a user 200. The invention 100 inserts in the mouth 210 of the user 200. A biting motion between the superior dentition 201 and the inferior dentition 202 of the mouth 210 creates a compressive force 143 that exercises the muscles around the jaw, tongue 203 and mouth 210 of the user 200.

The invention 100 comprises an enhanced mouthpiece 101, a data sensor 102, and a personal data device 103. The enhanced mouthpiece 101 comprises the original mouthpiece 111 described by non-provisional application U.S. Ser. No. 15/4470,983 which is incorporated into this disclosure in its entirety. The enhanced mouthpiece 101 is substantially identical in construction to the original mouthpiece 111. The enhancements made by the present disclosure to the original mouthpiece 111 to form the enhanced mouth 210 piece comprises the installation of the data sensor 102 into the enhanced mouthpiece 101. The data sensor 102 collects data regarding the bite force, the number of bites and the duration of each bite. The data sensor 102 wirelessly transfers the collected data to a personal data device 103.

The personal data device 103 is a programmable electrical device. The personal data device 103 further comprises an application 131. The personal data device 103 provides data management and communication services through one or more functions referred to as the application 131. The application 131 is a set of logical operating instructions that are performed by the personal data device 103. The addition of an application 131 will provide increased functionality for the personal data device 103. This disclosure assumes that an application 131 exists for the purpose of collecting and displaying the data collected by the invention 100. Methods to design and implement an application 131 on a personal data device 103 are well known and documented in the electrical arts.

The enhanced mouthpiece 101 is a mechanical structure. The enhanced mouthpiece 101 inserts in the mouth 210 of the user 200 between the superior dentition 201 and the inferior dentition 202. The enhanced mouthpiece 101 receives a compressive force 143 generated by the biting motion of the superior dentition 201 and the inferior dentition 202 during the exercise process. The enhanced mouthpiece 101 comprises an original mouthpiece 111 and a sensor cavity 112.

The original mouthpiece 111 is a mechanical structure. The original mouthpiece 111 inserts in the mouth 210 of the user 200 between the superior dentition 201 and the inferior dentition 202. The original mouthpiece 111 is the same as the mouthpiece described in the prior disclosure. The original mouthpiece 111 is described in greater detail elsewhere in this disclosure. The original mouthpiece 111 further comprises a cavity 141 and a removable insert 142. The original mouthpiece 111 receives the compressive force 143. The compressive force 143 refers to a force that is applied to the enhanced mouthpiece 101 when the superior dentition 201 and the inferior dentition 202 perform a biting motion.

The cavity 141 is a negative space that is formed through the center of the original mouthpiece 111. The cavity 141 is the same as the cavity in the mouthpiece that is described in the prior disclosure. The cavity 141 is described in greater detail elsewhere in this disclosure.

The removable insert 142 is a semi-rigid structure that is geometrically similar to the cavity 141 such that the removable insert 142 inserts into the cavity 141. The removable insert 142 is the same as the removable insert that inserts into the cavity of the mouthpiece that is described in the prior disclosure. The removable insert 142 is described in greater detail elsewhere in this disclosure.

The sensor cavity 112 is a negative space that is formed in the interior of the original mouthpiece 111. The sensor cavity 112 is sized to receive the data sensor 102 such that the data sensor 102 is contained within the original mouthpiece 111 to form the enhanced mouthpiece 101.

The data sensor 102 is an electrical circuit that collects information about the compressive force 143 during the exercise process. The data sensor 102 captures the measure of the compressive force 143 of each bite. The data sensor 102 captures the measure of the number and duration of bites applied to the enhanced mouthpiece 101. The data sensor 102 wirelessly transfers the collected data to the personal data device 103. The data sensor 102 comprises a logic module 121, a communication module 122, a piezoelectric sensor 123, and a power system 124.

The logic module 121 is a readily and commercially available programmable electronic device that is used to manage, regulate, and operate the data sensor 102. Depending on the specific design and the selected components, the logic module 121 can be a separate component within the data sensor 102 or the functions of the logic module 121 can be incorporated into another component within the data sensor 102. The communication module 122 is a wireless electronic communication device that allows the logic module 121 to wirelessly communicate with a personal data device 103. Specifically, the communication module 122 establishes a wireless communication link 151 between the data sensor 102 and the personal data device 103. In the first potential embodiment of the disclosure, the communication module 122 supports a Bluetooth™ protocol.

The piezoelectric sensor 123 is a disk-shaped plate. The piezoelectric sensor 123 has a non-Euclidean disk structure that allows the piezoelectric sensor 123 to fit within the sensor cavity 112 of the enhanced mouthpiece 101. The logic module 121, the communication module 122, and the power system 124 mount on the face of the piezoelectric sensor 123. The piezoelectric sensor 123 is formed from a piezoelectric material that generates a measurable voltage when the piezoelectric sensor 123 is subjected to a strain such as the compressive force 143.

The application of the compressive force 143 to the piezoelectric sensor 123 results in a change in voltage across the surface of the piezoelectric sensor 123 that is a positive function of the compressive force 143. The logic module 121 monitors the voltage across the face of the piezoelectric sensor 123 such that the logic module 121 will measure the: a) compressive force 143 applied to the piezoelectric sensor 123; b) the duration of each bite that generates the compressive force 143; and, c) the number of bites made by the user 200.

The power system 124 is an electrochemical device. The power system 124 converts chemical potential energy into electrical energy used to operate the data sensor 102. The power system 124 comprises a battery 161, a diode 162, a charging port 163, and an external power source 164. The external power source 164 further comprises a charging plug 165. The battery 161 is further defined with a first positive terminal 171 and a first negative terminal 181. The external power source 164 is further defined with a second positive terminal 172 and a second negative terminal 182.

The battery 161 is a commercially available rechargeable battery 161. The chemical energy stored within the rechargeable battery 161 is renewed and restored through the use of the charging port 163. The charging port 163 is an electrical circuit that reverses the polarity of the rechargeable battery 161 and provides the energy necessary to reverse the chemical processes that the rechargeable battery 161 initially used to generate the electrical energy. This reversal of the chemical process creates a chemical potential energy that will later be used by the rechargeable battery 161 to generate electricity.

The charging port 163 forms an electrical connection to an external power source 164 using a charging plug 165. The charging plug 165 forms a detachable electrical connection with the charging port 163. The charging port 163 receives electrical energy from the external power source 164 through the charging plug 165. The diode 162 is an electrical device that allows current to flow in only one direction. The diode 162 installs between the rechargeable battery 161 and the charging port 163 such that electricity will not flow from the first positive terminal 171 of the rechargeable battery 161 into the second positive terminal 172 of the external power source 164. In the first potential embodiment of the disclosure, the external power source 164 and the charging port 163 are compatible with USB power requirements.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front, or face side, of a human body. When comparing two objects, the anterior object is the object that is closer to the front, or face side, of the human body.

Application or App: As used in this disclosure, an application or app is a self-contained piece of software that is especially designed or downloaded for use with a personal data device.

Arch: As used in this disclosure, an arch refers to a curved edge or surface that bounds a definable object or surface.

Battery: As used in this disclosure, a battery is a chemical device consisting of one or more cells, in which chemical energy is converted into electricity and used as a source of power. Batteries are commonly defined with a positive terminal and a negative terminal.

Bluetooth™: As used in this disclosure, Bluetooth™ is a standardized communication protocol that is used to wirelessly interconnect electronic devices.

Cavity: As used in this disclosure, a cavity is an empty space or negative space that is formed within an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned.

When the center axes of two cylinder, prism or pyramidal structures do not share the same line they are said to be offset.

Compression Spring: As used in this disclosure, a compression spring is a wire coil that resists forces attempting to compress the wire coil in the direction of the center axis of the wire coil. The compression spring will return to its original position when the compressive force is removed.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Dental Arch: As used in this disclosure, the dental arch refers to the curvature formed by the dentition. There are two dental arches in a person that are commonly referred to as the superior dental arch and the inferior dental arch.

Dentition: As used in this disclosure, a dentition refers to a set of teeth and a set of descriptive characteristics of the set of teeth especially with regard to their number, kind, arrangement, and condition. The dentition is divided into a superior dentition and an inferior dentition.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its original shape after the force is removed. A material that exhibits these qualities is also referred to as an elastomeric material.

Exterior: As used in this disclosure, the exterior is used as a relational term that implies that an object is not contained within the boundary of a structure or a space.

External Power Source: As used in this disclosure, an external power source is a source of the energy that is externally provided to enable the operation of the present disclosure. Examples of external power sources include, but are not limited to, electrical power sources and compressed air sources.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Inferior: As used in this disclosure, inferior refers to a directional sense or location of the body. Specifically, inferior refers to an object or a side of an object that is proximal to the feet or distal from the head of the body.

Interior: As used in this disclosure, the interior is used as a relational term that implies that an object is contained within the boundary of a structure or a space.

Lateral: As used in this disclosure, lateral refers to a directional sense or location of the body. Specifically, lateral refers to an object or a side of an object that is proximal to the side or distal from the medial axis of the body.

Logic Module: As used in this disclosure, a logic module is a readily and commercially available electrical device that is programmable and that accepts digital and analog inputs, processes the digital and analog inputs according to previously stored instruction and provides the results of these instructions as digital or analog outputs.

Medial Axis: As used in this disclosure, the medial axis is the center line of the body as the line is drawn from the head to the foot. When two objects are compared relative to the medial axis, the object closer to the medial axis is referred to as the medial object, and the object distal from the medial axis is referred to as the lateral object.

Medial: As used in this disclosure, medial refers to a directional sense or location of the body. Specifically, medial refers to an object or a side of an object that is proximal to the medial axis or distal from the side of the body.

Modulus: As used in this disclosure, the modulus of an elastomeric object is a function that describes the percentage change in the span of the elastomeric object as a function of the force applied to the elastomeric object. When comparing modulus, a larger modulus is taken to imply that an increase in force is required to get the same percentage change in the elastomeric object.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

Non-Euclidean Prism: As used in this disclosure, a non-Euclidean prism is a prism structure wherein the center axis of the prism lies on a non-Euclidean plane.

Non-Euclidean Structure: As used in this disclosure, a non-Euclidean structure is a structure wherein an axis of the structure lies on a non-Euclidean plane.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

PDD: As used in this disclosure, PDD is an acronym for personal data device.

Perimeter: As used in this disclosure, a perimeter is one or more curved or straight lines that bounds an enclosed area on a plane or surface. The perimeter of a circle is commonly referred to as a circumference.

Personal Data Device: As used in this disclosure, a personal data device is a handheld logical device that is used for managing personal information and communication. Examples of personal data device include, but are not limited to, cellular phones, tablets, and smartphones. See logical device Piezoelectric Effect: As used in this disclosure, the piezoelectric effect refers to a class of materials wherein a strain placed upon the material will result in a redistribution of electrons within the material in a manner that causes an electric charge. This electric charge can be measured as a voltage potential across the material. This effect can be reversed in some of these materials such that the application of an AC voltage to the material will cause a vibration within the material. A material commonly used to take advantage of the piezoelectric effect is polyvinylidene difluoride (CAS 24937-79-9) which is also known as PVDF.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Posterior: As used in this disclosure, posterior is a term that is used to refer to the side of a human body that is distal from the anterior side. When comparing two objects, the posterior object is the object that is distal from the anterior side of the human body.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Superior: As used in this disclosure, superior refers to a directional sense or location of the body. Specifically, superior refers to an object or a side of an object that is distal from the feet or proximal to the head of the body.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors. A USB cable refers to a cable that: 1) is terminated with USB connectors; and, 2) that meets the data transmission standards of the USB standard.

Wireless: As used in this disclosure, wireless is an adjective that is used to describe a communication channel between two devices that does not require the use of physical cabling.

The directional references used in this disclosure correspond to the directional references from the perspective of a person. As such, left refers to the direction towards the left side of the person and right refers to the direction towards the right side of the person. Superior refers to the direction towards the head of the wearer and inferior refers to the direction towards the feet of the wearer. Anterior refers to the front side of the person, and posterior refers to the back side of the person.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A jaw exercise apparatus, comprising:

a mouthpiece configured for positioning between a superior dentition and an inferior dentition of a user, the mouthpiece comprising:

an anterior surface configured to be facing outward away from the user when the mouthpiece is positioned between the superior dentition and the inferior dentition of the user, and configured to be positioned forward of the superior dentition and the inferior dentition of the user;

a posterior surface opposite the anterior surface and configured to be facing inward toward the user when the mouthpiece is positioned between the superior dentition and the inferior dentition of the user;

a left side surface configured to be facing a left side of the user when the mouthpiece is positioned between the superior dentition and the inferior dentition of the user;

a right side surface configured to be facing a right side of the user when the mouthpiece is positioned between the superior dentition and the inferior dentition of the user;

a top surface configured to engage the superior dentition of the user;

a bottom surface configured to engage the inferior dentition of the user;

an interior surface defining at least one cavity, the interior surface having a continuous circumference around the at least one cavity to define parallel side walls between opposing openings in the anterior surface and the posterior surface or in the left side surface and the right side surface, wherein the anterior surface provides a continuous surface between the top surface and the bottom surface forward of the superior dentition and the inferior dentition of the user;

a sensor cavity configured to receive a data sensor operative to determine bite information corresponding to one or more compressive forces applied by the superior dentition and the inferior dentition of the user; and the data sensor.

2. The jaw exercise apparatus of claim 1, wherein the mouthpiece further comprises:

a superior dental arch cavity comprising a curvature configured to receive a superior dentition of the user and extending from the left side surface to the right side surface; and an inferior dental arch cavity comprising a curvature configured to receive an inferior dentition of the user and extending from the left side surface to the right side surface.

3. The jaw exercise apparatus of claim 2, wherein the superior dental arch cavity and the inferior dental arch cavity each comprises a channel or indentation formed in the exterior surface.

4. The jaw exercise apparatus of claim 2, wherein the superior dental arch cavity and the inferior dental arch cavity each comprises one or more pieces of material molded to the superior dentition or the inferior dentition of the user.

5. The jaw exercise apparatus of claim 1, wherein the one or more compressive forces corresponds to one or more bites from the user, the bite information comprising at least one of a bite force, a number of bites, and a duration of each bite.

6. The jaw exercise apparatus of claim 1, wherein the one or more compressive forces corresponds to one or more bites from the user, the bite information comprises a bite force, a number of bites, and a duration of each bite.

7. The jaw exercise apparatus of claim 1, wherein the data sensor comprises a logic module, a communication module, a piezoelectric sensor, and a power system.

8. The jaw exercise apparatus of claim 7, wherein the communication module comprises a wireless electronic communication device that provides wireless communications with a personal data device.

9. The jaw exercise apparatus of claim 8, wherein the wireless communication module is configured to provide the bite information to the personal data device via a Bluetooth protocol.

10. The jaw exercise apparatus of claim 1, wherein the mouthpiece further comprises a tongue shelf defined by the posterior surface.

11. The jaw exercise apparatus of claim 10, wherein the tongue shelf comprises a concave recess configured to receive at least a portion of a tongue of the user.

12. The jaw exercise apparatus of claim 1, wherein the mouthpiece comprises an elastomeric material.

13. A method for providing a jaw exercise apparatus, the method comprising:

forming a mouthpiece from elastomeric material configured for positioning between a superior dentition and an inferior dentition of a user, comprising:

forming an anterior surface of the mouthpiece configured to be facing outward away from the user when the mouthpiece is positioned between the superior dentition and the inferior dentition of the user, and configured to be positioned forward of the superior dentition and the inferior dentition of the user;

forming a posterior surface of the mouthpiece opposite the anterior surface and configured to be facing inward toward the user when the mouthpiece is positioned between the superior dentition and the inferior dentition of the user;

forming a left side surface of the mouthpiece configured to be facing a left side of the user when the mouthpiece is positioned between the superior dentition and the inferior dentition of the user;

forming a right side surface of the mouthpiece configured to be facing a right side of the user when the mouthpiece is positioned between the superior dentition and the inferior dentition of the user;

forming a top surface configured to engage the superior dentition of the user;

forming a bottom surface configured to engage the inferior dentition of the user; and forming at least one cavity defined by an interior surface, the interior surface having a continuous circumference around the at least one to define parallel side walls between opposing openings in the anterior surface and the posterior surface or in the left side surface and the right side surface; and forming a sensor cavity configured to receive a data sensor operative to determine bite information corresponding to one or more compressive forces applied by the superior dentition and the inferior dentition of the user, wherein the anterior surface is formed to provide a continuous surface between the top surface and the bottom surface forward of the superior dentition and the inferior dentition of the user.

14. The method of claim 13, further comprising installing the data sensor, wherein the data sensor comprises a logic module, a communication module, a piezoelectric sensor, and a power system, and wherein the one or more compressive forces corresponds to one or more bites from the user, the bite information comprising at least one of a bite force, a number of bites, and a duration of each bite.

15. A jaw exercise system, comprising:

a mouthpiece configured for positioning between a superior dentition and an inferior dentition of a user, the mouthpiece comprising:

an anterior surface configured to be facing outward away from the user when the mouthpiece is positioned between the superior dentition and the inferior dentition of the user, and configured to be positioned forward of the superior dentition and the inferior dentition of the user;

a posterior surface opposite the anterior surface and configured to be facing inward toward the user when the mouthpiece is positioned between the superior dentition and the inferior dentition of the user;

a left side surface configured to be facing a left side of the user when the mouthpiece is positioned between the superior dentition and the inferior dentition of the user;

a right side surface configured to be facing a right side of the user when the mouthpiece is positioned between the superior dentition and the inferior dentition of the user;

a top surface configured to engage the superior dentition of the user;

a bottom surface configured to engage the inferior dentition of the user; and a superior dental arch cavity comprising a curvature configured to receive a superior dentition of the user and extending from the left side surface to the right side surface;

an inferior dental arch cavity comprising a curvature configured to receive an inferior dentition of the user and extending from the left side surface to the right side surface;

an interior surface defining at least one cavity, the interior surface having a continuous circumference around the at least one cavity to define parallel side walls between opposing openings in the anterior surface and the posterior surface or in the left side surface and the right side surface; and a sensor cavity configured to receive a data sensor, wherein the anterior surface provides a continuous surface between the top surface and the bottom surface forward of the superior dentition and the inferior dentition of the user;

the data sensor operative to determine bite information corresponding to one or more compressive forces corresponding to one or more bites applied by the superior dentition and the inferior dentition of the user;

means for providing the bite information to the user.

16. The jaw exercise system of claim 15, wherein the data sensor comprises a logic module, a communication module, a piezoelectric sensor, and a power system.

17. The jaw exercise system of claim 16, wherein the bite information comprises at least one of a bite force, a number of bites, and a duration of each bite.

18. The jaw exercise system of claim 15, wherein the means for providing the bite information to the user comprises a set of logical operating instructions performed by a personal data device to receive the bite information from a communication module of the data sensor and to display the bite information for the user.

19. The jaw exercise system of claim 18, wherein the personal data device comprises a smartphone or a tablet, and wherein the bite information is transmitted wirelessly.

20. A jaw exercise apparatus, comprising:

a mouthpiece configured for positioning between a superior dentition and an inferior dentition of a user, the mouthpiece comprising:

an anterior surface comprising an elastic material and configured to be facing outward away from the user when the mouthpiece is positioned between the superior dentition and the inferior dentition of the user, and configured to be positioned forward of the superior dentition and the inferior dentition of the user;

a posterior surface opposite the anterior surface, comprising the elastic material, and configured to be facing inward toward the user when the mouthpiece is positioned between the superior dentition and the inferior dentition of the user;

a left side surface comprising the elastic material and configured to be facing a left side of the user when the mouthpiece is positioned between the superior dentition and the inferior dentition of the user;

a right side surface comprising the elastic material and configured to be facing a right side of the user when the mouthpiece is positioned between the superior dentition and the inferior dentition of the user;

a top surface configured to engage the superior dentition of the user;

a bottom surface configured to engage the inferior dentition of the user; and an interior surface defining at least one cavity in an uncompressed state, the interior surface having a continuous circumference around the at least one cavity to define parallel side walls between opposing openings in the anterior surface and the posterior surface or in the left side surface and the right side surface, wherein the anterior surface provides a continuous surface between the top surface and the bottom surface forward of the superior dentition and the inferior dentition of the user, and wherein the elastic material and a configuration of the at least one cavity allows for a first transition of the at least one cavity from the uncompressed state to a compressed state in response to receiving a bite force between the superior dentition and the inferior dentition of the user, and a second transition from the compressed state to the uncompressed state upon release of the bite force.

* * * * *